US006460603B1

(12) United States Patent
Damm et al.

(10) Patent No.: US 6,460,603 B1
(45) Date of Patent: Oct. 8, 2002

(54) APPARATUS FOR THE UPHILL LOW PRESSURE CASTING OF METALS, PARTICULARLY LIGHT METALS

(75) Inventors: Norbert Damm, Schaffhausen; Herbert Zulauf, Feuerthalen, both of (CH)

(73) Assignee: Georg Fischer Disa AG, Schaffhausen (CH)

( * ) Notice: Subject to any disclaimer, the term of this patent is extended or adjusted under 35 U.S.C. 154(b) by 0 days.

(21) Appl. No.: 09/401,808

(22) Filed: Sep. 22, 1999

(30) Foreign Application Priority Data

Sep. 22, 1998 (DE) ..... 198 43 285

(51) Int. Cl.[7] ..... B22D 17/06

(52) U.S. Cl. ..... 164/306; 164/309; 164/319; 164/321; 164/337

(58) Field of Search ..... 164/113, 306, 164/309, 319, 321, 119, 120, 337, 136, 358, 134

(56) References Cited

U.S. PATENT DOCUMENTS

| | | | | |
|---|---|---|---|---|
| 3,329,201 A | | 7/1967 | Miller, Jr. | |
| 5,730,203 A | | 3/1998 | Mogensen | 164/119 |
| 5,735,334 A | * | 4/1998 | Sutton et al. | 164/136 |

FOREIGN PATENT DOCUMENTS

| | | |
|---|---|---|
| DE | 1 105 115 | 4/1961 |
| DE | 24 37 734 | 2/1976 |
| DE | 19523819 | 2/1998 |
| EP | 0599768 | 6/1994 |
| EP | 0878256 | 3/1998 |

OTHER PUBLICATIONS

Abstract of Japanese Patent Publication 08–243724 published Sep. 24, 1996.*

R. A. Smith, Wilkins, P.S.A.: Niederdruck–Sandguss–Erfahrungen mit einem neuen Prozess. In: Giesserei–Praxis, Nr. 17, 1987, S247–252.

* cited by examiner

*Primary Examiner*—Tom Dunn
*Assistant Examiner*—I.-H. Lin
(74) *Attorney, Agent, or Firm*—Antonelli, Terry, Stout & Kraus, LLP

(57) ABSTRACT

An apparatus for uphill low pressure casting of metals in split sand moulds and having a sprue in one of the two moulds, to which can be connected the casting tube of a melt container and which is connected to the lowest area of the mould cavity, and having a sealing plug integrated into the mould and which after the filling of the mould cavity can be brought into the closed position by means of an external drive engaging in the mould, including a seal which does impairing casting quality and moulding sand preparation. Between the sprue and the mould cavity is provided a casting channel connecting the sprue and the mould cavity. The sealing plug is constructed as a sand mould body and in a shaped-in guide of the mould is displaceable between an open position and a closed position, and seals a casting channel and a metallostatic pressure of the molten metal in the mould acts against the guide on the sealing plug.

19 Claims, 8 Drawing Sheets

APPARATUS FOR THE UPHILL LOW PRESSURE CASTING OF METALS, PARTICULARLY LIGHT METALS

BACKGROUND OF THE INVENTION

1. Field of the Invention

The invention relates to an apparatus for the uphill low pressure casting of metals, particularly light metals, in split sand moulds with a gate or sprue in one of the two moulds, to which is connectable the casting tube of a melt container and which is connected with the lowest area of the mould cavity, and with a sealing plug integrated into the mould and which following the filling of the mould cavity by means of an external drive engaging in the mould can be brought into the closed position.

2. Description of the Prior Art

In the uphill casting of metals the melt is placed under an overpressure in the melt container or a holding furnace, in order to force the melt via the casting tube and the sprue in rising manner into the mould cavity. Following the filling of the mould the melt column in the casting tube and in the mould sprue must be interrupted, in order to convey away the poured off mould and to be able to dock the next mould with the casting tube. Before this the melt must be returned in the casting tube. In addition, precautions must be taken with respect to the mould so that during the further conveying on of the mould the sprue is closed at least until the melt has solidified in the sprue. This takes place e.g. by moving the mould onto cooling plates or cooling plates carried along with the mould.

For sealing the mould after filling, sealing slides integrated into the mould and located at the sprue are known (WO 93/11892, WO 95/32826), which can be moved from an open position during casting into a closed position shutting off the sprue. In the case of sand moulds, either with or without boxes or flasks, the problem arises that the slide made from a different material must be segregated during the processing of the mould sand. Frequently there is an adhesion thereof to the solidified metal in the sprue and removal must take place through a separate operation.

In a known construction (WO 95/32826, DE-journal "Giesserei", 1998, pp 57 to 62) following the filling of the mould by means of an external drive engaging in the sand mould from the side, moulding sand is displaced from the area alongside the sprue into the latter and is intended to displace the sprue in a plug-like manner. Considerable abrasion occurs, which is displaced into the melt both in the direction of the casting tube and in the direction of the mould cavity. The moulding sand particles displaced towards the casting tube remain in the melt on return or resetting and are conveyed into the mould cavity during the next casting process, which leads to considerable quality losses with respect to the casting, particularly if it is made from light metal, e.g. aluminium alloys.

An attempt is made to prevent the displacement of moulding sand into the melt in that downstream of the sealing plug is positioned a particle filter (DE-journal "Giesserei"), or in that (WO 95/32826), the sprue is initially guided downwards by the casting tube neck and in this falling area of the sprue the drive engages in the mould in order to displace the moulding sand in plug-like manner into the falling portion of the sprue. This construction is counter to the fundamental requirement of a very short sprue path. The falling portion is also opposed to the principle of uphill casting and can lead in this area to undesired turbulence during the pouring off of the mould. Although both constructions have the advantage that the mould contains no type-foreign components, because the sealing plug is made from the same moulding sand as the mould and consequently can be processed with the moulding sand of the mould, the disadvantage remains in both cases that sealing takes place in a completely uncontrolled manner and the quality of the seal is dependent on the shape stability, the pressing-out force acting on the moulding sand through the drive and the time force gradient. It is in particular not ensured that an intact, sealed plug is formed and that the mould does not break off laterally of the forced-out plug. These risks are particularly high with large sprue cross-sections for high casting capacities.

SUMMARY OF THE INVENTION

On the basis of this prior art, the problem solved by the invention is to provide an apparatus in which, whilst maintaining the type-pure composition of the sand mould, a completely satisfactory seal is possible in the vicinity of the sprue and also, even in the case of a high casting capacity and large sprue cross-sections, the quality of the seal remains in a reproducible manner and finally the risk of carrying moulding sand particles into the melt is minimized.

According to the invention this problem is solved in that between the sprue and the mould cavity is provided at an angle to the sprue a casting duct or channel linking the same and that the sealing plug is constructed as a sand mould body and is displaceable in a shaped-in guide of the mould between an open position and a closed position, where the sealing plug closes the casting channel and the metallostatic pressure of the melt in the mould acts perpendicular to the guide on the sealing plug.

In the construction according to the invention, the sealing plug is pre-shaped as a sand mould body. In the sand mould there is both a guide for the sealing plug and also a casting channel at an angle to the sprue, namely in the vicinity of the mould parting plane. The casting channel is preferably at right angles or under a steep, obtuse angle to the flow direction in the sprue. In the case of high castings, which consequently extend correspondingly deeply into said mould, the casting channel must also be correspondingly deep. The final cross-section of the casting channel can be determined by an inserted core.

The melt is deflected within the mould from the sprue into the casting channel. In the vicinity of the deflection is provided the guide with the sealing plug and the sealing plug is initially located in the open position freeing the transition between sprue and casting channel. Following mould filling, the sealing plug constructed as a sand mould body is displaced by means of the external drive engaging in the mould inside the guide into the closed position, in which the transition between the sprue and the casting channel is displaced away from the sealing plug. In the closed position the metallostatic pressure of the mould acts transversely to the guide on the sealing plug, so that the latter remains in its position.

As the sealing plug is a separate moulding, there is only minimum abrasion on the guide or sand mould body, so that the risk of carrying moulding sand particles into the casting tube on returning the melt is very small. It is also possible to produce the sealing plug from the same moulding sand as the mould, so that it can be processed during the preparation of the moulding sand. As a result of the separate prefabrication, the hardness of the sand mould body can be optimized in accordance with the intended use.

In a preferred development the sealing plug is held in the open position in self-locking manner in the guide. The self-locking action can be brought about by a correspondingly close fit of sealing plug and guide, optionally assisted by frictional forces due to surface roughnesses.

With horizontally positioned moulds and a roughly vertical sprue, the sealing plug can also be placed with clearance in the guide and e.g. rest on a step or the like. When filling the mould, the sealing plug is raised into the open position as a result of the melt buoyancy force and in this position it seals in the guide, e.g. engages against an annular step or is sealed against the guide surface by a conical construction of the guide. Instead of being made from moulding sand, in the manner indicated hereinbefore, the sealing plug-forming sand mould body can also be produced from core sand. In both cases a surface smoothing by the application of a blackwash is recommended.

In an other preferred development, the guide is constructed as a bush from a core sand and is inserted in prefabricated receptacles of the mould, the bush having recesses opening radially into the casting channel for melt overflow and which can be sealed by means of the sealing plug inserted in the bush.

As a result of the construction of the guide as a core sand bush it is possible to achieve better guidance characteristics for the sealing plug. The bush also has a greater strength, so that the shear forces acting on the sealing plug constitute no risk for the guide bush. For identical external dimensions and correspondingly identical receptacles in the mould, as regards arrangement and size of the recesses for the overflow of the melt, the bush can be adapted to the given circumstances. As the bush is made from core sand, it does not constitute a foreign body in the standard sand processing process.

The guide, no matter whether it is directly formed in the moulding sand or as a core sand bush, extends from the mould having the sprue, via the mould parting plane into the other mould, so that it is ensured that the casting channel positioned transversely to the sprue is completely sealable.

If the guide is formed by an inserted bush, then in both moulds are provided facing receptacles for the bush. The core sand bush has the advantage that even with a displacement of the moulds in the parting plane, a linear, smooth guidance for the sealing plug is ensured.

As a precaution, downstream of the sealing plug can be located a particle filter integrated into the mould. In the case of a separate guide bush, the particle filter can be inserted in the bush at its melt feed, so that the bush with sealing plug and particle filter can be inserted in the mould in a single operation.

With horizontal moulds, the guide for the sealing plug is equiaxial with the substantially vertical sprue and the casting channel is approximately horizontally positioned in the lower mould. Then, in the upper mould, there is a bore equiaxial with the guide for the engagement of the drive of the sealing plug from above. Thus, the drive acts in the mould from the side opposite to the sprue.

For vertical moulds with a lateral runner and an approximately horizontal sprue, the casting channel is roughly vertical and the sealing plug with its guide is positioned parallel above the sprue and transversely to the casting channel. Thus, in this case the melt initially flows horizontally to the mould and is then deflected vertically into the casting channel which, after filling the mould, is displaced by the sealing plug movable transversely thereto.

In the case of moulds with several discreet mould cavities, which are filled by means of a central sprue with radially positioned casting channels perpendicular thereto, the guide with the sealing plug is equiaxial to the sprue and the casting channels are attached to said guide, so that following the filling of all the mould cavities the casting channels can be moved with a single sealing plug.

The drive for the sealing plug is advantageously a pressure cylinder, whose piston rod engages in a shaped-in or subsequently mechanically fitted bore in the mould. The drive can preferably be controlled in such a way that a piston rod thereof, prior to the filling of the mould, is movable into a readiness position supporting the sealing plug against the pressure of the melt in the open position.

BRIEF DESCRIPTION OF THE DRAWINGS

The invention is described in greater detail hereinafter relative to non-limitative embodiments and the attached drawings, wherein show.

DESCRIPTION OF THE PREFERRED EMBODIMENTS

Figure 1:
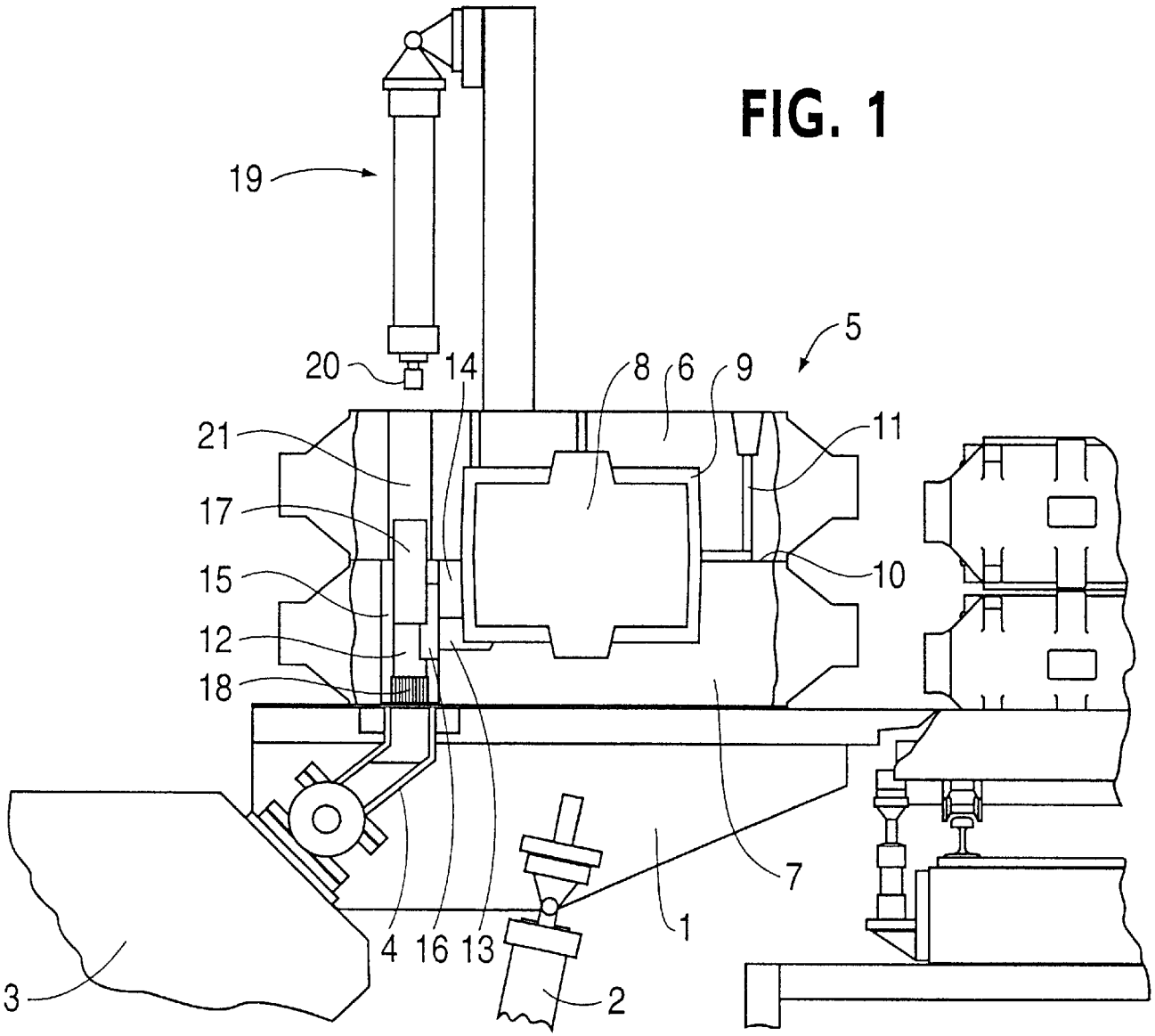
FIGS. 1 to 4 A diagrammatic view of a first embodiment in different positions during casting.
Figure 2:
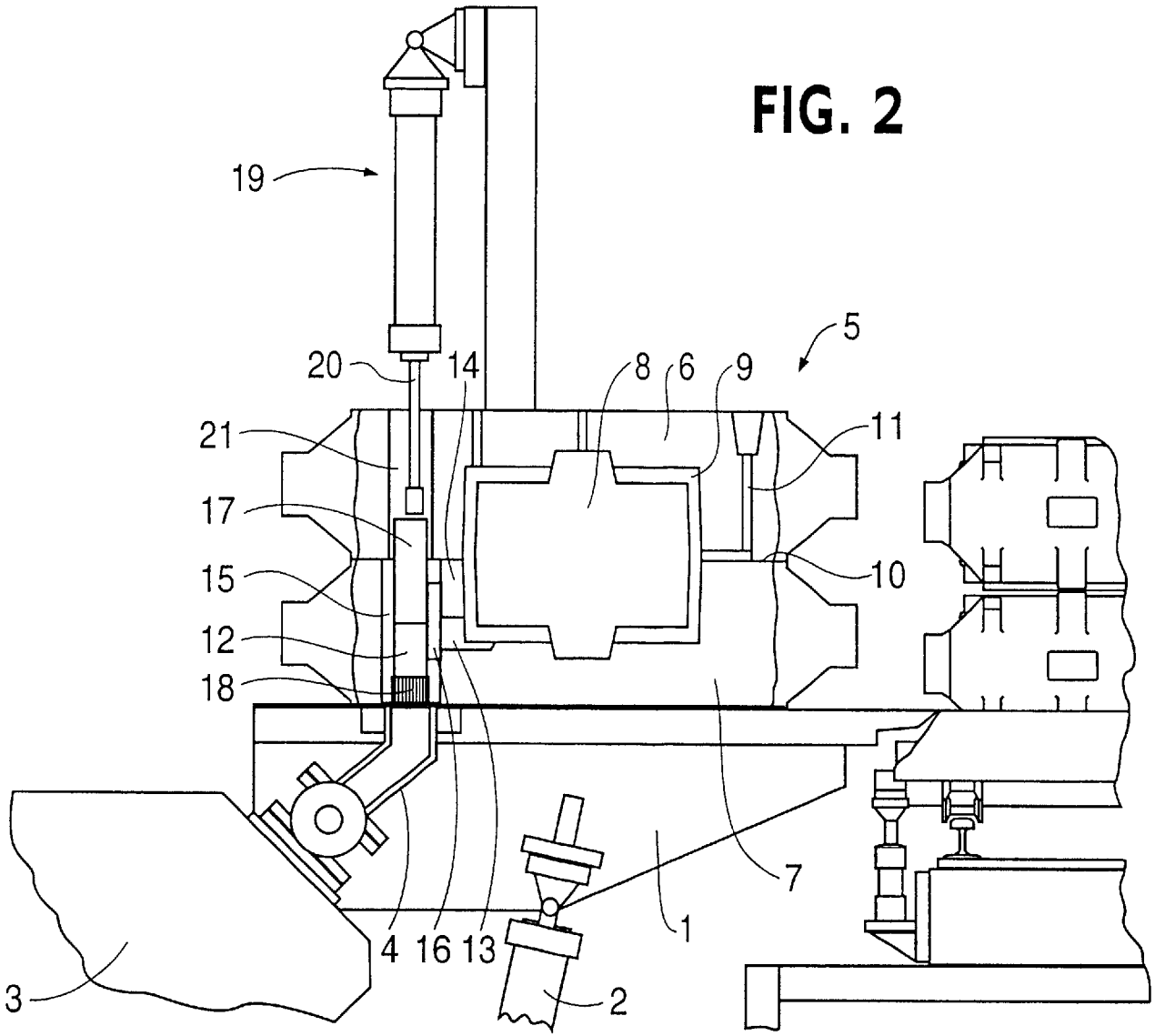

The invention is described relative to the drawings in conjunction with box moulds, but it can also be used for boxless moulds.

FIGS. 1 to 5 show in exemplified manner a mould frame 1, which can optionally be tilted by means of a lifting cylinder 2. Below and alongside the mould frame 1 is provided a melt container 3, optionally in the form of a holding furnace. Into the melt, which is under an overpressure and located in the melt container 3, is immersed a casting tube 4, which issues at the mould frame.

On the mould frame is placed the sand mould 5, which in the embodiment shown comprises an upper box mould 6 and a lower box mould 7, in which is also inserted a core 8. Between the upper box mould 6 and lower box mould 7, as well as the mould core 8 is formed the mould cavity 9. In the mould parting plane 10, the upper box mould 6 also has a riser 11 connected to the mould cavity 9.

On one side the lower box mould 7 has a substantially vertical gate or sprue 12, to which is connected roughly at right angles a casting channel or duct 13, which in the vicinity of the lowest point of the mould cavity 9 issues into the latter. The casting channel 13 formed from the mould parting plane 10 is in this embodiment upwardly bounded by a core 14 inserted from the mould parting plane. Such a core is only necessary for very high castings with a correspondingly low ingate. With flat or shallow castings the casting channel 13 can be directly located in the mould parting plane.

A guide 15 is also shaped into the mould and in the represented embodiment is formed by an inserted bush, which is made from core sand. However, the guide can also be directly constructed in the moulding sand of the mould. In the embodiment shown the guide 15 in the form of a bush has a radially open window 16, by means of which the interior of the guide 15 is connected to the casting channel 13.

The guide 15 contains a sealing plug 17, which is in the form of a moulding sand or core sand body. The guide 15 and sealing plug 17 are so matched to one another that the plug 17 is held in a self-locking manner in the open position shown in FIG. 1. It can optionally also be bonded in. Downstream of the sealing plug 17 a particle filter 18 is inserted in the guide 15. The apparatus also has an external drive 19, which in the embodiment shown is constructed as a pressure cylinder, whose piston rod 20 can engage in a bore 21 in the upper box mould 6 equiaxial to the sprue 12.

Figure 3:
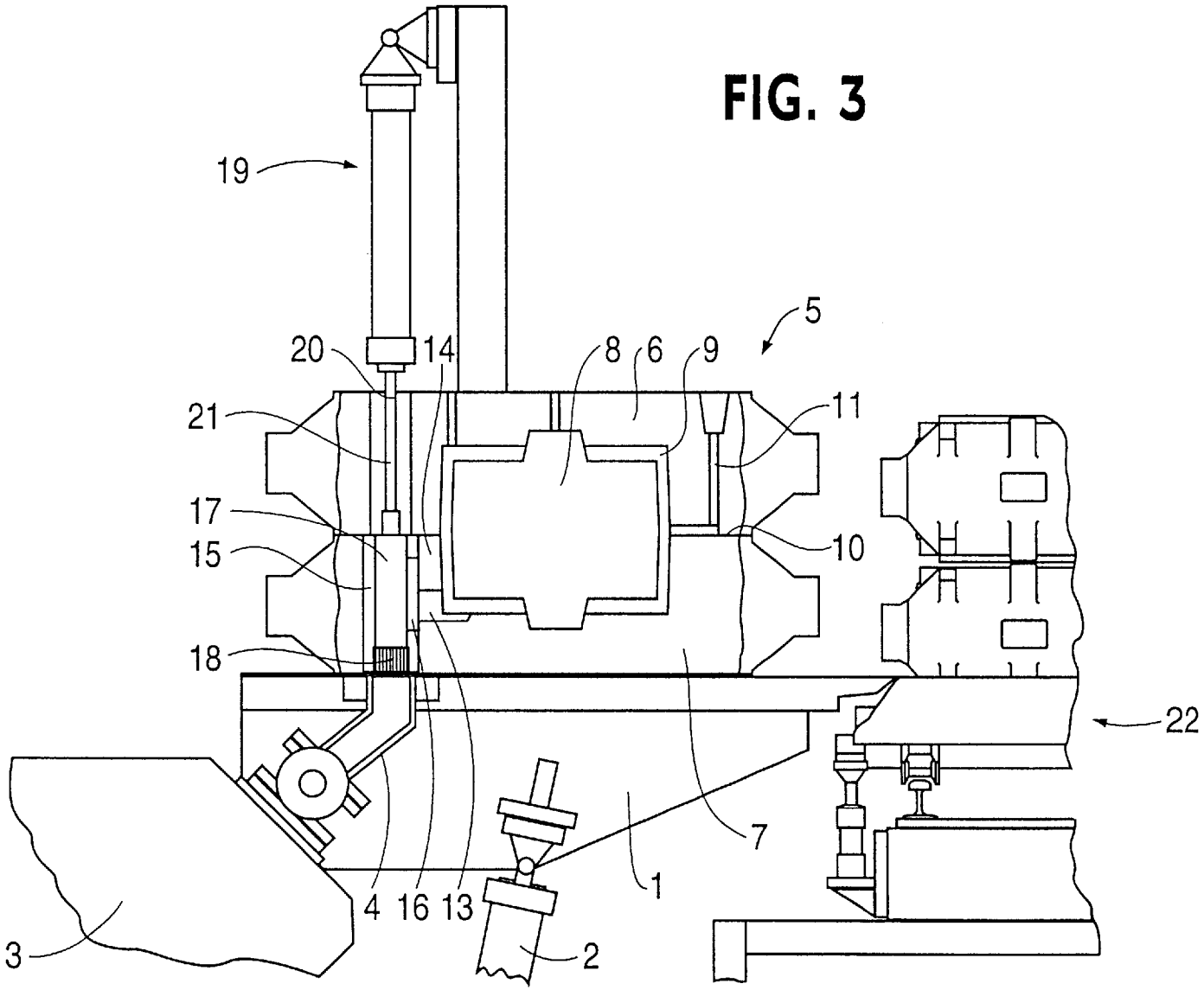
Figure 4:
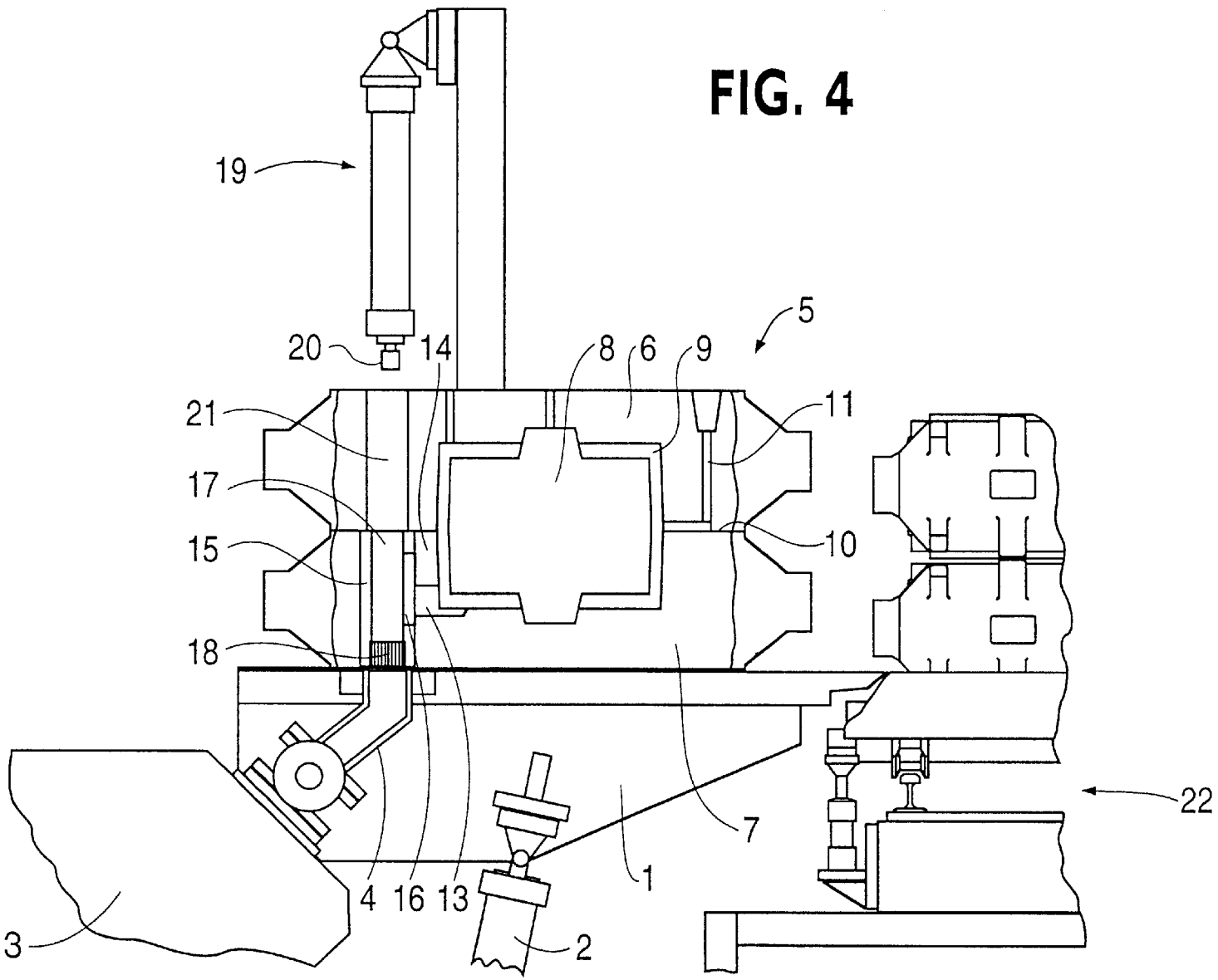

FIG. 1 shows the starting position prior to casting, in which the melt column in the casting tube 4 is reset or returned and is also pressureless. Prior to the start of the casting process, the piston rod 20 is extended to such an extent that it engages on the sealing plug 17 and holds the latter in position against the melt pressure (FIG. 2), after which the casting process begins. The melt rises from the casting tube 4 into the sprue and guide 15 and from here via the window 16 and casting channel 13 into the mould cavity 9. When the mould cavity 9 is filled, the drive 19 is controlled and the piston rod 20 moves the sealing plug 17 downwards until the window 16 in the guide 15 is covered (FIG. 3). Immediately thereafter the melt can be returned into the casting tube and after extending the piston rod 20 into the position according to FIG. 4, the mould is uncoupled from the casting tube 4 and is e.g. shoved onto a conveyor belt 22 alongside the mould frame 1. The casting station according to FIGS. 1 to 4 can naturally also be integrated into such a conveyor belt 22.

With horizontal moulds 5 the sealing plug 17 can also be located with clearance in the guide and rests in the starting position e.g. on the particle filter 18. When the melt rises in the sprue 12, the sealing plug 17 is raised by the buoyancy force until it frees the recess 16 and in the open position is sealingly supported on an annular step on the guide or with a conical guide construction on the latter. This minimizes the air cushion above the melt level and calms the melt front accelerated in the constricted filter cross-section.

Figure 5:
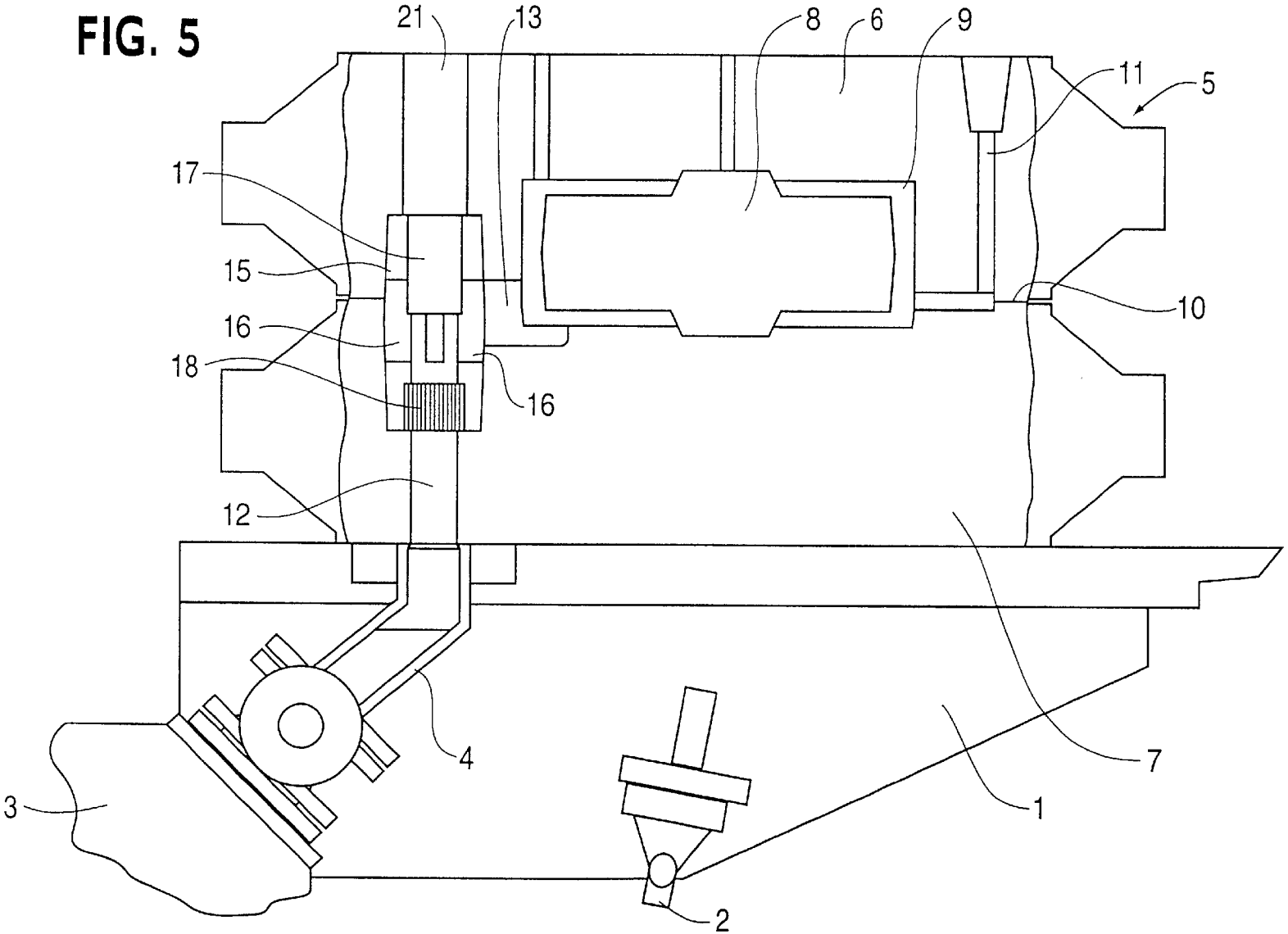
FIG. 5 A larger-scale partial view similar to FIG. 1 in a modified construction.

FIG. 5 shows an embodiment for flatter or shallower castings modified somewhat compared with FIGS. 1 to 4, where for the same parts the reference numerals of FIGS. 1 to 4 are used. Once again the guide 15 is in the form of a preshaped core sand bush, which is provided with several radially opening windows 16, whereof one is oriented with the casting channel 13. Once again the guide 15 receives the sealing plug 17 and also on its opposite side the particle filter 18. Thus, the guide 15, sealing plug 17 and particle filter 18 can be prefitted and the unit can be inserted in a corresponding receptacle on the lower box mould 7. The upper box mould 6 has a corresponding receptacle, so that following the fitting of the upper box the bush forming the guide 15 is positioned.

Figure 6:
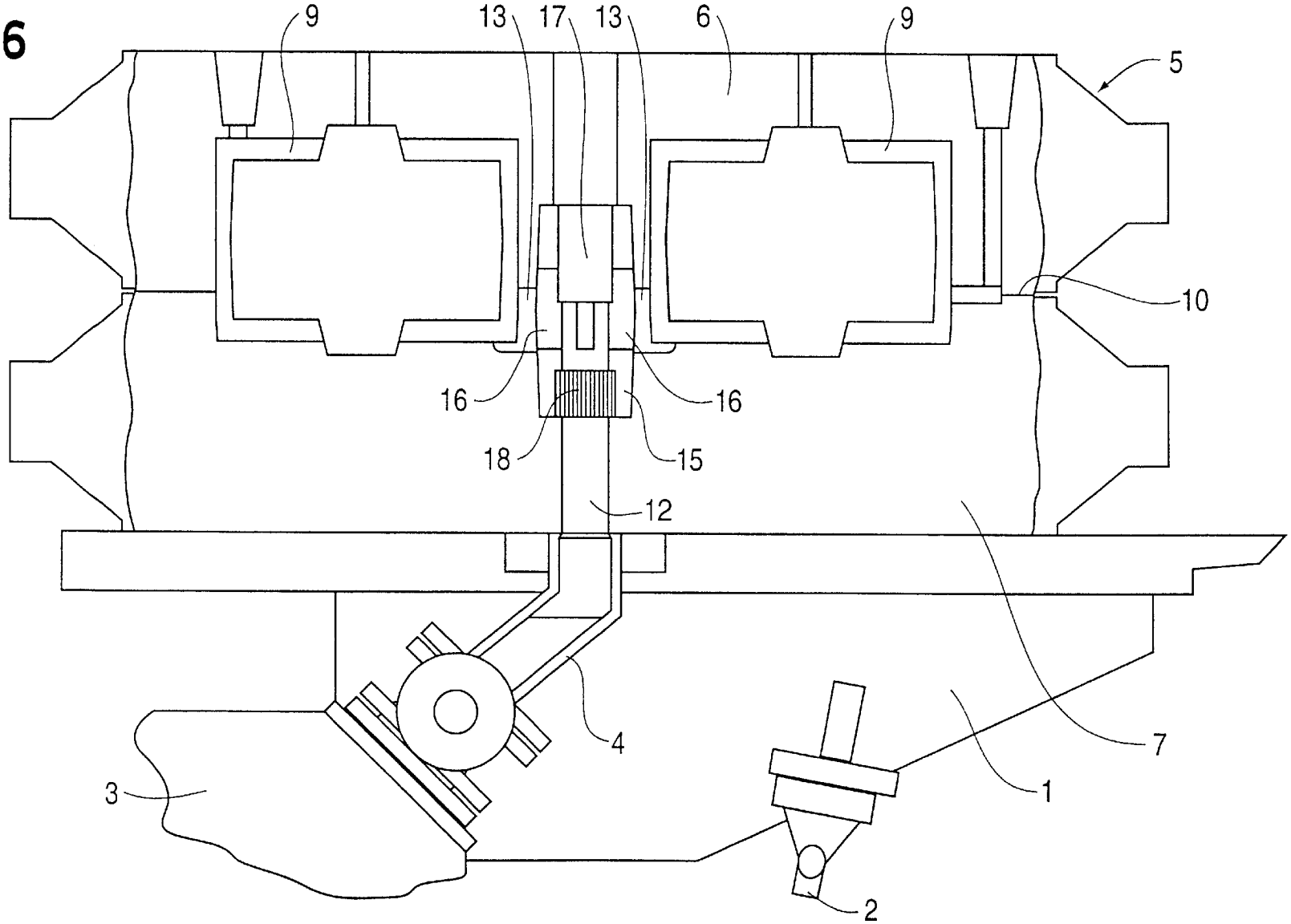
FIG. 6 A view of another embodiment corresponding to FIG. 5.

In the embodiment according to FIG. 6, the mould 5 has several discreet mould cavities, as are conventionally used with multiple moulds. In this case, the sprue 12 is centrally positioned and the casting channels 13 emanate substantially radially therefrom. In the mould parting plane is once again located the guide 15 for the sealing plug 17. The guide 15 has at least two diametrically facing windows 16, which are in each case correlated with a casting channel 13. The operation is the same as described relative to FIGS. 1 to 4 with the difference that both mould cavities 9 are simultaneously filled via the sprue 12 and interior of the guide 15, as well as the two casting channels 13. At the end of the casting process the sealing plug 17 is moved downwards until it displaces both windows 16.

Figure 7:
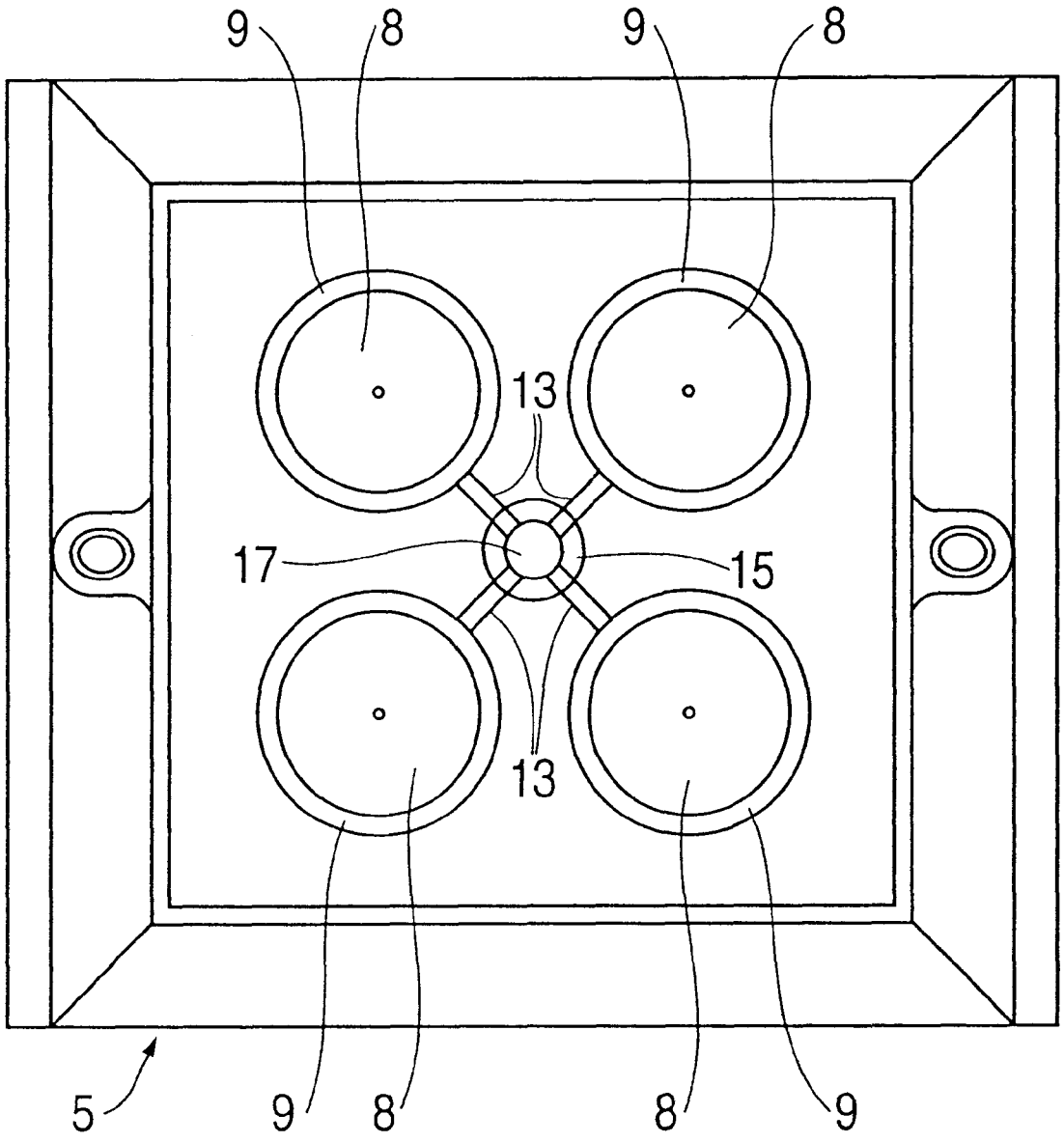
FIG. 7 A plan view of another embodiment.

FIG. 7 shows an embodiment of a mould 5 with four discreet mould cavities 9 and a central sprue, to which is attached the vertically positioned casting channels 13. Equiaxially with the sprue is once again provided a guide 15 in the form of a core sand bush with four windows for each casting channel 13.

The sealing plug 17 is displaceable in the guide 15.

Figure 8:
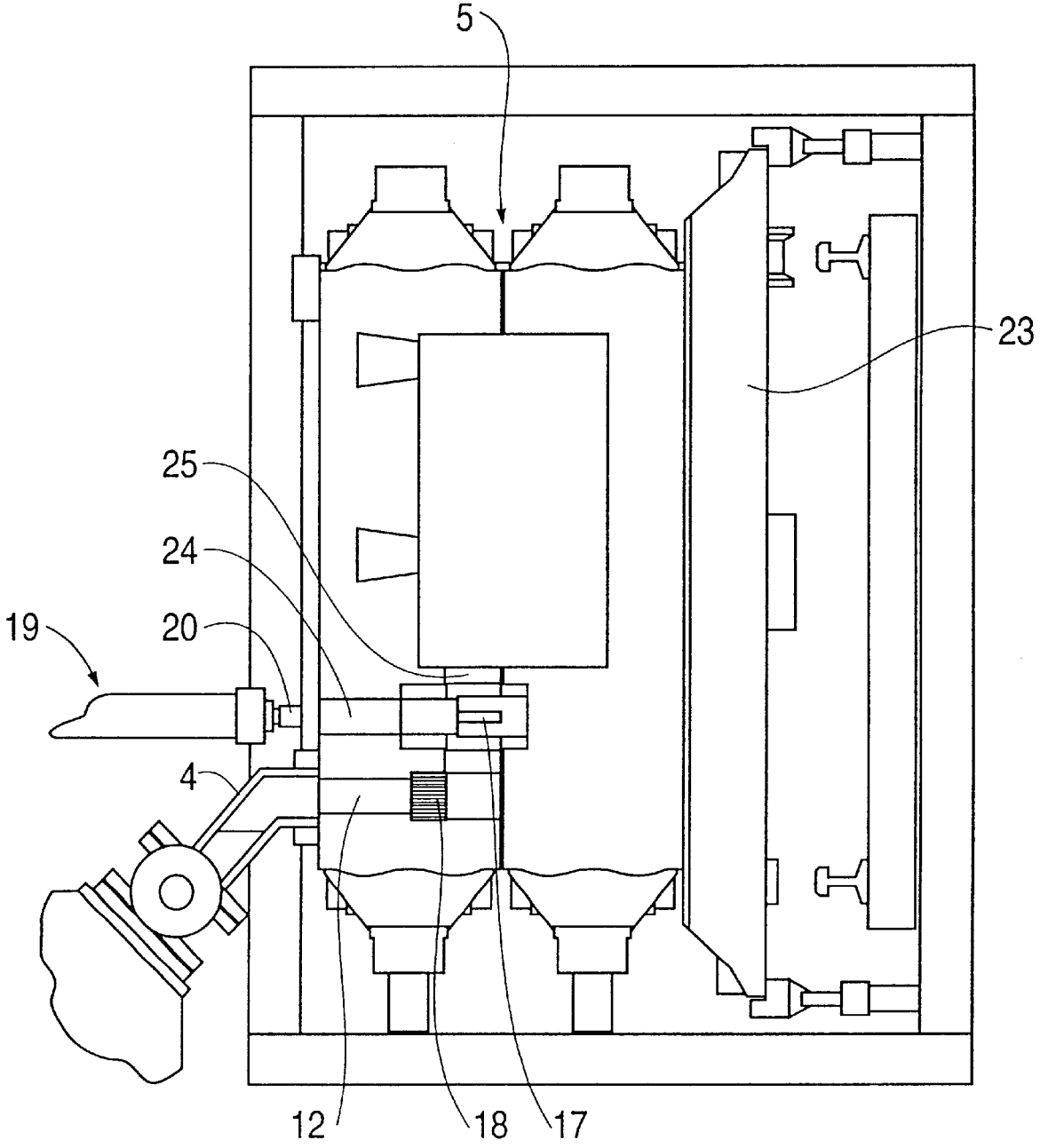
FIG. 8 An embodiment of the apparatus with vertically positioned moulds.

In the embodiment according to FIG. 8 the mould 5 is positioned vertically. This situation e.g. occurs if the mould is transported on pallets 23 and is tilted out of the conveying path into the vertical position. In such a situation the mould is poured off from the side. For this purpose the casting tube 4 is horizontal at least in its mould-side area and is also roughly horizontal to the sprue 12. In the sprue-side mould is formed a bore 24, which has in the vicinity of the mould parting plane, like the other mould, a receptacle for the guide 15 of the sealing plug 17. In the sprue-side mould is also formed a casting channel 25, which is in this case is roughly vertical and also substantially perpendicular to the sprue. In this case the particle filter 18 is located at the transition from the sprue 12 into the casting channel 25. Laterally of the mould 5 is provided the drive 19 with the piston rod 20, which engages in the bore 24 and moves the sealing plug 18 out of the indicated open position, following the filling of the mould, into the closed position.

In all the embodiments the sealing plug 15 is so positioned in the closed position, that the metallostatic pressure of the mould acting thereon takes place perpendicular to the guide, i.e. likewise braces the sealing plug in the guide, so that there is a constantly acting seal.

What is claimed is:

1. Apparatus for uphill low pressure casting of metals, in a split sand mould comprising:

a sprue in the split sand mould, a casting tube connected to a melt container which is connectable to the sprue and which is connected with a lowest area of a mould cavity, a sealing plug integrated into the split sand mould and being movable by an external drive, while engaging the split sand mold from an open position into a closed position following filling of the mould cavity with melt; and wherein between the sprue and the mould cavity is provided a casting channel linking the mould cavity to the sprue with a direction of flow of melt in the sprue being at an angle with a direction of flow of melt in the casting channel, the sealing plug is constructed as a sand mould body and is displaceable in a shaped guide of the split sand mould between the open position and the closed position sealing the casting channel and metallostatic pressure of the melt in the split sand mould acts perpendicular to the guide and on the sealing plug.

2. An apparatus according to claim 1, wherein the sealing plug is held locked in the guide while in the open position.

3. An apparatus according to claim 1, wherein the split sand mould is horizontal and the sealing plug is inserted with clearance in the guide and when the mould is filled with metal the sealing plug is raisable into an open position, under a buoyancy force of the melt, and seals against the guide.

4. An apparatus according to claim 3 wherein a guide for the sealing plug is equiaxial with a sprue directed with a vertical component and the casting channel is disposed with a horizontal component in a lower part of the split sand mould.

5. An apparatus according to claim 3, wherein an upper part of the split sand mould includes a bore equiaxial to the guide and in which from above a drive engages the sealing plug.

6. An apparatus according to claim 1, wherein the split sand mould comprises moulding sand.

7. An apparatus according to claim 6, wherein the split sand mould body is smooth with a blackwash.

8. An apparatus according to claim 1, wherein the split sand mould comprises core sand.

9. An apparatus according to claim 1, wherein the guide comprises a core sand bush inserted in preshaped receptacles of the split sand mould including melt overflow recesses opening radially into the casting channel which are sealable by the sealing plug inserted to the sand core bush.

10. An apparatus according to claim 9, wherein the guide extends from a part of the split sand including the sprue, from a mould parting plane into another part of the split sand mould.

11. An apparatus according to claim 9, wherein the core sand bush is placed in a receptacle of parts of the split sand mould.

12. An apparatus according to claim 9, wherein a part of the split sand mould having the sprue includes a bore equiaxial and parallel to the guide for the sealing plug and in which a drive engages the sealing plug from a side of the lateral runner.

13. An apparatus according to claim 1 comprising a particle filter is provided downstream of the sealing plug.

14. An apparatus according to claim 13 wherein the particle filter is located at a melt feed of the core sand bush.

15. an apparatus according to claim 14, wherein the particle filter is inserted in the core sand bush.

16. An apparatus according to claim 1, wherein the split sand mould is vertical, includes a lateral runner and a horizontally positioned sprue, the casting channel includes a vertical component and the guide with the sealing plug is positioned above, substantially parallel to the sprue and transversely to the casting channel.

17. An apparatus according to claims 1, wherein a drive for the sealing plug is a pressure cylinder including a piston rod movable into the split sand mould.

18. An apparatus according to claim 17 wherein, prior to the filling of the mould, the piston rod of the drive is movable into a position supporting the sealing plug against the pressure of the melt while the sealing plug is in the open position.

19. An apparatus in accordance with claim 1 wherein the angle is substantially 90°.

* * * * *